United States Patent [19]

Werginz

[11] 4,206,881

[45] Jun. 10, 1980

[54] CONE CRUSHER ANTI-SPIN MECHANISM

[75] Inventor: Karl Werginz, Dunwoody, Ga.

[73] Assignee: Litton Systems, Inc., Columbia, S.C.

[21] Appl. No.: 22,225

[22] Filed: Mar. 19, 1979

Related U.S. Application Data

[62] Division of Ser. No. 880,060, Feb. 22, 1978, Pat. No. 4,168,036.

[51] Int. Cl.[2] ..... B02C 2/04

[52] U.S. Cl. ..... 241/207

[58] Field of Search ..... 241/207–216

[56] References Cited

U.S. PATENT DOCUMENTS

| | | | |
|---|---|---|---|
| 3,107,868 | 10/1963 | Barrot et al. | 241/211 |
| 3,227,381 | 1/1966 | Golucke | 241/208 |
| 3,539,119 | 11/1970 | Cook | 241/215 |
| 3,887,143 | 6/1975 | Gilbert et al. | 241/215 |
| 4,037,800 | 7/1977 | Coyhill | 241/213 |

*Primary Examiner*—Howard N. Goldberg
*Attorney, Agent, or Firm*—Herbert A. Stern

[57] ABSTRACT

A cone crusher characterized by a frame having a completely fabricated construction, an anti-spin mechanism and an improved crusher setting indicator is disclosed. The frame of the structure, which is composed solely of pre-formed and/or forged members, includes a number of tubular members, a number of annular members and a number of ribs, all of which are welded together to provide a rigid, strong frame. The anti-spin mechanism is characterized by the use of a unidirectional valve and a spring loaded ball valve, thereby permitting the rotation of the mantle of the crusher in one direction while barring rotation of the mantle in the opposite direction unless a force exceeding a pre-selected magnitude is applied to the mantle. The crusher setting indicator, which is used to determine the distance between the moveable mantle and the stationary concave of the crusher includes a rod supported by the crusher, the rod abutting the cone support bearing seat of the crusher, the position of which seat is directly related to the position of the mantle. A pinion gear is coupled to the rod and the orientation of the gear is used to provide an indication of the distance between the mantle and concave.

6 Claims, 8 Drawing Figures

CONE CRUSHER ANTI-SPIN MECHANISM

This is a division of application Ser. No. 880,060, filed 2/22/78, now U.S. Pat. No. 4,168,036, issued Sept. 18, 1979.

This abstract is not to be taken either as a complete exposition or as a limitation of the present invention, the full nature and extent of the invention being discernable only by reference to and from the entire disclosure.

BACKGROUND OF THE INVENTION

This invention relates to cone crushers and more particularly to such crushers which have fabricated upper and lower main frames. In addition, this invention relates to such cone crushers which include anti-spin mechanisms and crusher setting indicators.

Cone crushers, which are devices well known in the art, are devices which are adapted to receive large pieces of hard material such as, for example, large chunks of rock and to reduce them to a large number of smaller pieces which are of a generally uniform size. The crushers which are presently widely used in the concrete and aggregate industry have numerous characteristics which make them less than ideal. For example, such crushers must have extraordinarily strong main frames due to the fact that they are subject to extreme mechanical stresses. For this reason, among others, such crushers have generally been provided with cast frames. Although such cast frames have generally proved to be of sufficient strength, the cost of their manufacture is quite high and they are therefore, from an economic point of view, less than completely satisfactory. In an effort to overcome this negative aspect it has been proposed to fabricate the lower portion of the main frame of such a crusher from pre-formed components rather than to cast it and to thereby obtain substantial savings. An example of such a cone crusher which includes a fabricated lower main frame portion is provided in U.S. Pat. No. 3,150,839. It is noted, however, that even this patent teaches a crusher main frame structure which includes cast members, in particular, this patent teaches a structure utilizing a cast center hub. The industry, recognizing the advantages of fabricated main frames for crushers has attempted to provide main frame structures which are completely fabricated, that is, contain only plate and forged members and contain no cast members. An example of a crusher frame which is constructed from only fabricated members is provided by U.S. Pat. No. 3,843,068 which is fabricated solely from pre-formed components which are welded together. Such structures, although providing definite advantages over the earlier cast structures are nevertheless not completely satisfactory in that they frequently require great number of components to fullfill their function. For example, the last noted patent includes an adapter plate for permitting the mating of the center hub with the countershaft which houses the required motor drive shaft. Clearly, this results in less than a completely satisfactory solution to the problem because a greater number of prefabricated sections requires a greater number of welds. This, in turn, provides the opportunity for unsatisfactory welds and results in increased expense in that each of the welds must be (or should be) inspected either by X-ray or ultra-sonic techniques or both.

As indicated above, the function of a crusher is to provide, for subsequent use, stones, crushed rock, etc.

of a uniform size. Clearly, therefore, it is important to be able to determine, prior to operation of the crusher, the magnitude of the crushed material which will be provided by the crusher unit, that is, the crusher setting. Presently known crusher setting indicators are not, however, completely satisfactory in that they are either mechanically complex and expensive or they do not provide information regarding the size of the material to be provided by the crusher with a desired degree of accuracy. It is, of course, possible to accurately and inexpensively determine the crusher setting by measuring the size of the material after it passes through the crushing chamber and is emitted from the crusher but such information is obviously of less utility than is knowledge of the crusher setting prior to operation of the crusher.

Cone crushers of the type here under discussion include a gyratory member generally referred to in the art as a mantle. Due to the construction of the crusher, the gyrating mantle has a tendency to rotate in a first direction when the crusher is not under load, that is when the crusher is not in the process of crushing material. Further, the mantle tends to rotate in a second direction, opposite to the first direction, when the crusher is under load. As is well known in the art, rotation of the mantle in the first (no load) direction is to be avoided because such rotation can cause additional and extensive wear to the expensive mantle. It is therefore quite common in the crusher art to provide what is frequently referred to as an anti-spin mechanism. The mechanisms presently known frequently are in the form of devices which absolutely bar the rotation of the mantle in the first direction while permitting the mantle to freely rotate in the second rotation. The utility of such mechanisms has proved to be less than completely satisfactory because absolutely barring the rotation of the mantle in the first direction, may, under conditions where the mantle is being urged in the first direction with sufficient force, result in the destruction of components of the crusher.

SUMMARY OF THE INVENTION

It is therefore an important object of the present invention to provide an improved cone crusher anti-spin mechanism by means of which the aforenoted drawbacks and disadvantages may be most efficaciously avoided.

It is a further object of the instant invention to provide an anti-spin mechanism for a cone crusher which inhibits the rotation of the crusher mantle in a selected direction but which nevertheless permits such rotation in the event the mantle is urged in such direction with a force exceeding a pre-selected magnitude.

It is yet another object of the instant invention to provide an anti-spin mechanism for a cone crusher which prevents damage to the crusher by releasing the crusher mantle for rotation in an otherwise undesired direction when the mantle is urged in said direction by a force exceeding a pre-selected magnitude.

Generally speaking, the objects of the instant invention are attained by the provision of an anti-spin mechanism for a cone crusher, the cone crusher including a gyratory mantle which is urged to rotate in a first direction when the crusher is under load and in a second direction, opposite to the first direction, when the crusher is not under load, comprising a reservoir containing a fluid, a fluid pump positioned within the reservoir and coupled to the mantle, the pump adapted to urge the fluid in a first flow direction when the mantle rotates in the first direction and to urge the fluid in a second flow direction, opposite to the first flow direction, when the mantle rotates in the second direction, the force with which the pump urges the fluid to flow being directly related to the force with which the mantle is urged to rotate, a first valve positioned in the reservoir and coupled to the fluid pump, the first valve arranged to provide a fluid flow path only when the pump urges the fluid to flow in the first flow direction, and a second valve positioned in the reservoir and coupled to the fluid pump, the second valve arranged to provide a fluid flow path only when the pump urges the fluid to flow in the second direction with a force exceeding a predetermined magnitude.

The foregoing and other objects of features of the present invention will be more clearly understood from the following detailed description thereof when read in conjunction with the accompanying drawings, in which:

DESCRIPTION OF THE PREFERRED EMBODIMENT

Figure 1:
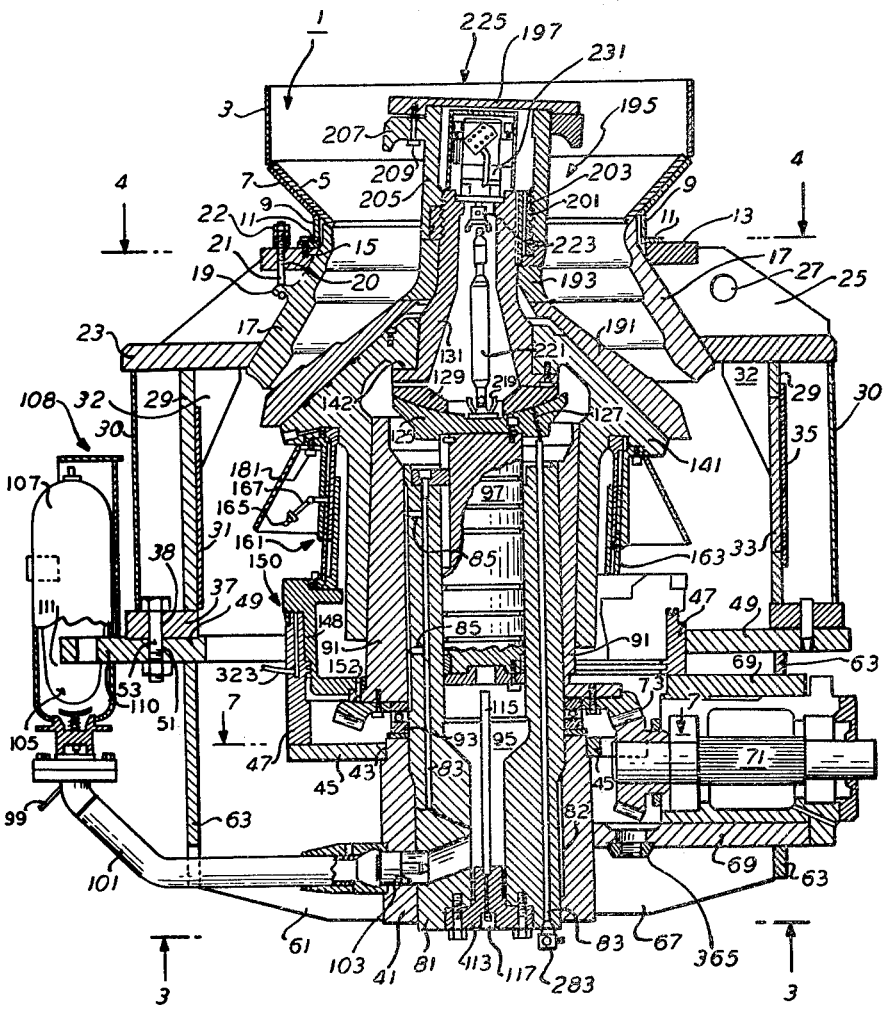
FIG. 1 is a cross-sectional plan view of the cone crusher of the instant invention.

Referring now to FIG. 1 there is illustrated the cone crusher of the instant invention. The crusher includes a frame which is in two portions, that is, upper and lower main frame portions, these portions being bolted together to form the crusher main frame. Turning first to the upper main frame portion, there is illustrated a feed hopper (although feed hoppers are generally considered by the art to be separate from, and not form part of, a crusher frame, the feed hopper herein will be described as if it formed part of the upper main frame portion) generally indicated at 1 which includes a fabricated tubular member 3, which member may be fabricated from bend rolled steel plate. A fabricated member 5, which has the general cross-sectional configuration of a truncated cone and a fabricated member 7 which also has the general cross-sectional configuration of a truncated cone are both welded, at their upper peripheries, to the member 3. The members 5 and 7 are also welded to one another along their contiguous lengths, it being noted that the member 5 is longer than the member 7. A fabricated tubular member 9 is welded at its upper periphery to the lower periphery of the truncated member 7 and to the side of the member 5. The tubular member 9 is further welded, at its lower periphery, to an annulus 11, the combination of the tubular member 9 and annulus 11 having an L-shaped cross-sectional configuration. The annulus 11 is formed with a plurality of holes therein and it is thereby adapted to be firmly affixed to an annulus 13, which is formed with a plurality of countersunk threaded holes, by any conventional means, for example, by screws such as the one indicated at 15.

An upper crushing member or concave 17 having the general cross-sectional configuration of a truncated cone is cast from an extremely hard and long wearing material such as, for example, manganese steel, and it is formed with a plurality of gripping or hook members, one of which is indicated at 19. The concave 17 is maintained in position by a plurality of gripping members 21 which pass through apertures 20 formed in the annulus 13, which gripping members 21 may have any desired configuration. In the embodiment illustrated in FIG. 1, the gripping members 21 each have a "T" shaped cross-section although a member having a "J" shaped cross-section could also be utilized. Conventional tightening nuts, such as those indicated at 22 serve to draw the gripping members 21 upwardly, thereby drawing the concave 17 upwardly to its desired position. An annulus 23, oriented so as to be parallel to both the annuli 11 and 13 is positioned in the vicinity of the lower end of the concave 17.

A plurality of gussets or ribs 25 which are oriented orthogonally with respect to the annuli 13 and 23 are welded to the annuli 13 and 23 so as to form a rigid support therebetween. The ribs 25 are equally spaced circumferentially and there may be, for example, 16 such ribs spaced 22.5° apart, as clearly seen in FIG. 4. A plurality of the ribs 25 are formed with apertures 27 therethrough so as to facilitate the lifting of the upper portion of the fabricated main frame of the crusher when separation of the upper and lower main frame portions is desired. As indicated above, the crusher may include 16 of the ribs 25 and, for example, four of the ribs, spaced 90° apart, might be formed with apertures such as the one indicated at 27.

A fabricated tubular member 29, which may be formed of bend rolled sheet steel, is welded at its upper periphery to the annulus 23. Apertures such as the one indicated at 33 are formed at various locations about the periphery of the tubular member 29 which apertures may be blocked by, for example, hinged doors such as the one indicated at 35 so that access may be had to the interior of the crusher when such access is required.

Figure 4:
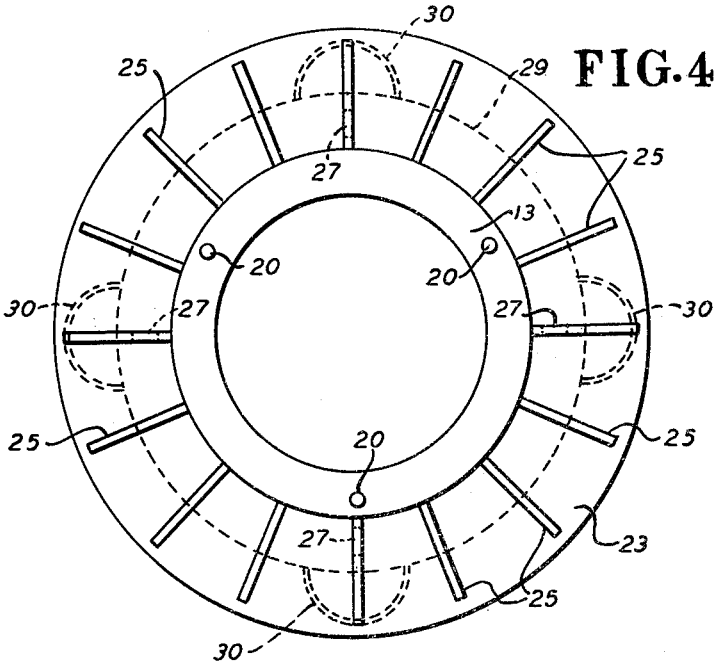
FIG. 4 is a cross-sectional plan view taken along lines 4—4 of FIG. 1.

A number or ribs, for example, four, most clearly shown in dotted lines in FIG. 4 are uniformly spaced about the circumference of the upper main frame portion of the crusher. The ribs 30, which have "U" shaped cross-sectional configurations (the open ends of the "U" abutting the tubular member 29 and the closed end of the "U" extending in a radially outward direction) are welded, at their upper peripheries, to the annulus 23. The ribs 30 are also welded, at their open ends, to the tubular member 29. A tubular wear liner 31, which may be made of a long wearing material such as low carbon steel and which may be formed by rolling, is tack welded at a number of points to the radially inward surface of the tubular member 29. The wear liner 31 serves to reduce the wear of the tubular member 29 which would be caused by the action of the crushed material being processed by the crusher unit and, of course, the liner may be removed and replaced when necessary. A number of ribs or gussets 32, for example, eight such gussets, are welded to the annulus 23, the tubular member 29, and the wear liner 31 so as to combine the annulus 23, the member 29 and the liner 31 into a rigid structure. A horizontal annulus 37 is welded to the lower peripheries of the tubular member 29 and the "U" shaped rib 30. The annulus 37 is formed with a plurality of apertures 38 formed therein through which bolts may be passed for attaching the just described upper main frame portion to the lower main frame portion of the cone crusher, which lower portion will be described in detail below.

Figure 7:
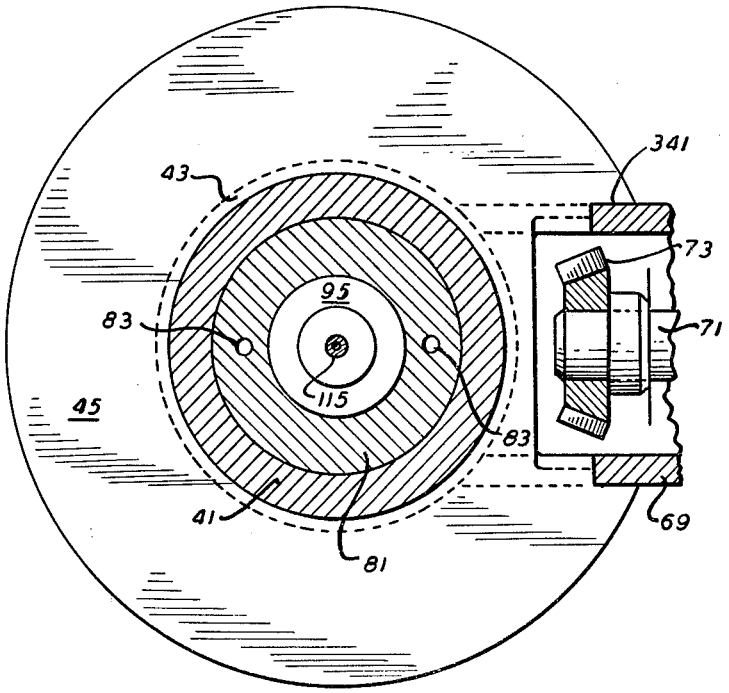
FIG. 7 is a cross-sectional plan view taken along lines 7—7 of FIG. 1.

Turning now to a description of the lower main frame portion and referring to FIG. 1, it is seen that the lower main frame portion includes a forged steel center hub 41 which has an annular shoulder 43 formed at the upper end thereof. An annulus 45 (which is illustrated in FIG. 7 and which will be described in greater detail below) is welded to the hub 41 at the shoulder 43 and a fabricated tubular member 47, which may be, for example, of bend rolled steel plate, is welded to the annulus 45 at the outer periphery thereof. An annulus 49, oriented to extend orthogonally relative to the member 47 is welded thereto interadjacent the ends thereof. The annulus 49 is formed with a plurality of apertures 51 being so located as to be in alignment with the apertures 38 which extend through the annulus 37. It may therefore be seen that the annuli 37 and 49 may be rigidly attached to one another by, for example, a bolt and nut combination such as indicated at 53 thereby accomplishing the connection of the upper and lower main frame portions.

Figure 3:
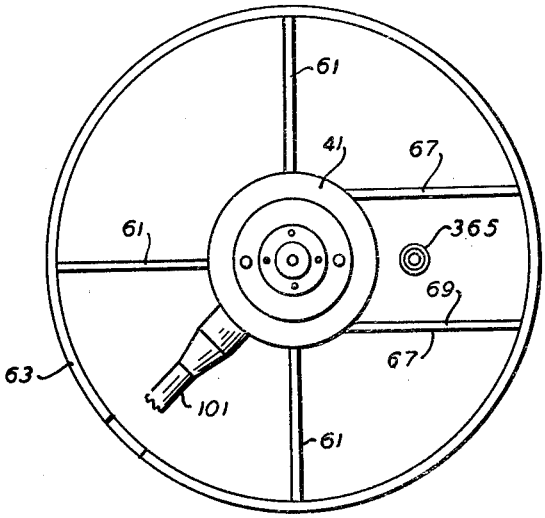
FIG. 3 is a plan view taken along lines 3—3 of FIG. 1.

A plurality of ribs or gussets 61, for example, three (most clearly seen in FIG. 3), are welded to the forged center hub 41 and to a fabricated tubular member 63 which may be formed or bend rolled sheet steel. The tubular member 63 extends orthogonally relative to the annulus 49 and the member 63 is welded, at its upper periphery, to the annulus 49. In addition, the ribs 61 are welded to the annulus 45, to the tubular member 47 and to the annulus 49, thereby imparting substantial strength and rigidity to the fabricated lower main frame portion.

A driving mechanism is, as is conventional, provided for the crusher of the instant invention in a manner which will be explained below and to this end there is provided, as part of the lower main frame, a drive shaft housing. The space for the drive shaft housing is provided by forming, for example, by burning, a circular aperture in the tubular member 63, the aperture formed extending through the tubular member 47 and the annulus 45. It will be understood of course that the annulus 45 may either be provided as a complete annulus, a portion subsequently being removed therefrom, or, alternatively, the annulus 45 may originally be formed as a slotted circular plate (the slot having parallel side walls) as indicated in FIG. 7. A fabricated tubular member 69 which may, for example, be made of bend rolled sheet steel extends through the aforementioned circular aperture and forms the drive shaft housing. The drive shaft, which is indicated generally at 71, is of any conventional form and may be used to drive the inventive crusher in any conventional manner. For example, the embodiment of the invention illustrated in FIG. 1 shows the drive shaft 71 driving the cone crusher by means of a conventional bevel gear which is indicated generally at 73.

As was noted above with respect to the ribs 61, a number of ribs 67, in this embodiment, two (most clearly seen in FIG. 3), are welded to the center hub 41, the tubular member 63 and to the tubular member 69. The ribs 67, therefore, also impart substantial strength and rigidity to the fabricated lower main frame portion and differ from the ribs 61 only in that the ribs 67 do not extend upwardly to the annulus 49 as do the ribs 61, the ribs 67 terminating at the drive shaft housing member 69.

Turning now to a description of the internal structure of the cone crusher, it is seen that the crusher includes a forged shaft 81 having at least two lubrication paths 83 formed therein. Additional lubricational paths, such as those indicated at 85 are also formed in the shaft 81. It is also appropriate to note at this point that the tubular hub 41 is formed with a stepped bore indicated at 82. The stepped bore 82 is formed with an internal diameter which is slightly greater than the internal diameter of the hub 41 in the lowest portion thereof so as to facilitate the insertion of the shaft 81 into the center hub 41. Surrounding the shaft 81, which is stationary during the operation of the crusher, is an eccentric sleeve 91. The eccentric sleeve 91, which is driven by the drive shaft 71 through the mechanism of the bevel gear 73, extends upwardly to a point beyond the uppermost portion of the shaft 81 and downwardly to a bearing 93 which is in turn supported by the hub 41, the bearing 93 facilitating the rotation of the eccentric sleeve about the shaft 81. To reduce the wear of both the shaft 81 and the eccentric 91, a bearing of relatively soft alloy metal may be positioned between the adjacent bearing surfaces of the shaft 81 and the eccentric 91. Alternatively, a layer of relatively soft alloy metal, such as, for example, an alloy including lead, tin and antimony may be coated onto one or both of the bearing surfaces as is the case in the embodiment illustrated.

The interior of the tubular shaft 81 serves as a piston chamber, indicated at 95, and a piston 97 is positioned therein. The piston 97 is actuated by hydraulic fluid which is provided by a mechanism, not shown, through a conventional tubing and coupling combination, generally indicated at 99, to a section of conventional tubing indicated at 101. The tubing 101, together with a conventional hydraulic coupling, extends through a passage, indicated at 103, formed in the hub 41 and the shaft 81. The tubing 101 extends at its other end to a coupling 105 by means of which it is connected to an accumulator 107. The accumulator 107 is supported by a frame, indicated generally at 108. The frame 108 is attached to the lower portion of the main frame by any conventional means such as, for example, a clamp indicated at 110. It is here appropriate to note that, for reasons which wil be discussed below, a gas containing bag 111 is positioned within the hydraulic fluid accumulator 107. As previously noted, the interior of the shaft 81 serves as the piston chamber 94, and as illustrated, the chamber extends through the bottom of the shaft 81. To prevent the hydraulic fluid within the chamber 95 from exiting through the bottom of the shaft 81 a conventional plug or bleeder flange 113 is inserted into the opening in the shaft 81 and the plug 113 is affixed to the shaft 81 by any conventional means, such as, for example, the screws shown. An air tube 115, supported at its lower end by the plug 113, extends into the piston chamber 95 and up to the bottom of the piston 97. The tube 115 terminates, at its lower end, in a valve 117 positioned, for protection, in a groove in the plug 113. In this manner air trapped below the piston 97 may be released into the atmosphere through the valve 117.

Supported by the piston 97 is a support cone bearing seat 125 which may be affixed to the piston 97 by any conventional means such as a plurality of screws, one of which is illustrated. Formed in the support cone bearing seat 125 in a lubrication passage 127 which is aligned with the lubrication passage 83 formed in the shaft 81.

Supported by the support cone bearing seat 125 is the support cone bearing 129 and supported by the support cone bearing 129 is a clutch housing 131. Supported by and attached to the clutch housing 131 is a support cone 141 which support cone is supported by a circular shoulder 142 formed at the lower end of the clutch housing 131. The support cone 141 is in annular abutting relationship with the eccentric sleeve 91 and the support cone 141 extends downwardly for almost the entire length of the sleeve 91. To reduce the wear of both the sleeve 91 and the support cone 141 a layer of relatively soft alloy metal is coated onto one or both of the bearing surfaces of the cone 141 and the sleeve 91.

A steel flywheel 148 is connected to the eccentric 91 by, for example, a bolt such as the one indicated at 152 and the flywheel 148 is arranged to rotate with the eccentric 91. Connected between the support cone 141 and the flywheel 148 is a grease filled labyrinth seal indicated generally at 161, the purpose of which is to prevent grit such as particles of rock, rock dust, etc. from entering the internal structure of the cone crusher where such particles would cause excessive wear. The labyrinth seal includes a plurality of tubular sealing rings 163. In the embodiment here illustrated, there are four such rings 163, two of which are upper sealing rings, extending downwardly from the support cone 141 and two of which are lower sealing rings, each of which extends upwardly from the flywheel 148. It will be noted that the sealing rings 163 are arranged in an interlacing relationship so that grease injected into the voids between the rings 163 will effectively prevent grit from entering the internal structure of the crusher. As most clearly illustrated in FIG. 6, one or more grease fittings, indicated at 165, are provided about the periphery of the labyrinth seal 161 and these fittings 165 are connected, by means of tubing 167, to a port 169 formed in the radially outwardmost one of the sealing rings 163. A wear collar 181, which collar may be made of low carbon steel, is welded to the support cone 141, the collar 181 extending generally in the area of the upper half of the seal 161. The wear collar 181 thus prevents damage to the labyrinth seal structure 161 which might be caused by crushed material, which has passed through the crushing chamber, striking the sealing rings 163.

Supported by the support cone 141 is a mantle 191 which has the cross-sectional configuration of a truncated cone. Supported by the uppermost portion of the mantle 191 is a collar 193 which has a generally flared tubular or bell-like configuration. The collar 193 forms part of a hydraulic nut assembly, indicated generally at 195, which assembly will be more fully described below. Supported by, and attached to, the hydraulic nut assembly 195 is a feed plate 197 which may be made of low carbon steel. The plate 197 serves to distribute the material provided to the crusher evenly about the crushing chamber and to protect the uppermost portion of the internal structure of the cone crusher.

Turning now to a more detailed description of the hydraulic nut 195, it may be seen that a nut 201 is threaded onto the externally threaded clutch housing 131 forcing the collar 193 downwardly and thereby urging the mantle 191 into song engagement with the support cone 141. To increase the downward force applied by the collar 193 to the mantle 191, a hydraulic pump, not shown, applies, via tubing 203, hydraulic fluid under pressure to a chamber bounded by the lower portion of the nut 201 and the upper portion of the collar 193. The hydraulic fluid thus urges the nut 201 upwardly and the collar 193 downwardly. The nut 201 cannot, however, move upwardly because it is threaded onto the clutch housing 131. The pressure of the hydraulic fluid thus forces the collar 193 downwardly. When the system has been pressurized to a desired degree (the collar urged downward with a predetermined force), a lock nut 205 is threaded onto the outer periphery of the nut 203 (which nut 203 is threaded externally as well as internally), until the nut 205 is snug against the collar 193. At this time the hydraulic pressure may be released and the nut 205, the nut 201 and the collar 193 will maintain the mantle in place.

It is appropriate to note at this time that the nut 205 is formed with a plurality of ears, for example, four, in which axially extending holes are formed. The holes formed in the ears 207 are so spaced as to be in alignment with a plurality of countersunk, threaded, axially extending holes formed in the under-surface of the feed plate 197, thereby permitting screws, such as the one indicated at 209, to hold the feed plate in position.

Supported by the support cone bearing seat 125 and connected thereto by a conventional universal joint 219 such as, for example, a Hooke's joint, is a shaft 221. The shaft 221 is connected, by means of a conventional universal joint 223 to an anti-spin mechanism, indicated generally at 225. The anti-spin mechanism 225, which is most clearly shown in FIG. 2, includes a hydraulic motor or pump 231. The drive shaft of the motor is connected, by means of the collar 233, to the universal joint 223. Fixedly positioned within the space formed by the feed plate 197, the nut 205 and the clutch housing 131 is a generally cubical hydraulic reservoir 241. As will be understood, lubricating fluid provided to the cone crusher via the lubricating passages 83 and 127 fills the open area in which the shaft 221 is located and, by means of ports (not shown), the interior of the reservoir 241. Fixedly positioned in any conventional manner within the lubricating oil filled reservoir 241 are a manifold 243, a check valve 245, and a relief valve 247, each of which is conventional and which may be hydraulically coupled in any conventional manner. For reasons which will be discussed below a length of tubing 249 extends from the manifold to the lower portion of the reservoir 241 to insure a supply of hydraulic fluid (the lubricating oil) for the operation of the anti-spin mechanism 225. It should be pointed out, however, that although the instant arrangement illustrates a manifold located in the upper region of the reservoir 241, an equivalent structure could obviously be provided by locating the manifold and motor in the lower portion of the reservoir 241, thereby insuring an adequate supply of hydraulic fluid for the operation of the anti-spin mechanism without the need of tubing such as that indicated at 249. Further, although the check valve 245 and the relief valve valve 247 are illustrated as being at opposite sides of the reservoir 241 with the manifold 243 positioned therebetween, other hydraulically equivalent configurations could obviously be utilized. For example, an arrangement wherein the relief valve, the check valve and the manifold are vertically arranged at one side of the reservoir 241, with the relief valve being positioned uppermost and the manifold being positioned at the bottom the reservoir chamber, would clearly provide an equivalent structure. The shaft of the motor 231 which is, as previously noted, coupled to the shaft 221 by means of the universal joint 223 does not rotate. Rather, the motor 231 is arranged for rotation. The motor, by means of the motor housing fixedly connected thereto, is connected directly to the clutch housing 131 and it will therefore be obvious that the rotation of the clutch housing, the support cone 141 and the mantle 191 will be directly related to the rotation of the motor 231. Alternatively, however, it may be desired to attach the motor housing to a conventional base plate which could, for example, take the form illustrated in FIG. 2 at 261 and to attach the base plate 261 to the clutch housing 131, thereby accomplishing the same end.

Figure 5:
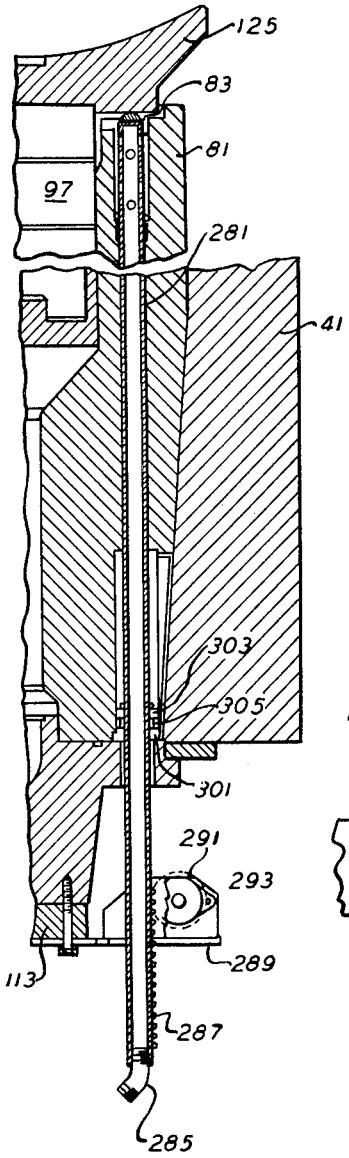
FIG. 5 is a detailed cross-sectional plan view of the crusher setting indicator of the instant invention.

Turning now to FIG. 5, there is illustrated, in detail, the crusher setting indicator of the instant invention. The crusher setting indicator includes a tubular rod 281 which is located within the lubrication path 83 formed in the shaft 81 and the rod may be made of any suitable material, for example, steel. The uppermost portion of the rod 281 is in contact with the support cone bearing seat 125 and its lowermost portion, indicated at 285, extends into a lubrication fitting 283 located just below the lowermost portion of the lubrication path 83. It is appropriate to note at this point that the rod 281, which is located within the lubrication path 83, is tubular so that the rod itself may serve as a portion of the path for the lubricating medium. The lower portion of the rod 281 bears (may be formed or fitted with) a series of gear teeth (a rack) indicated generally at 287. A pinion gear 291 is mounted on any convenient support, for example, on a plate extending from the bleeder flange 113. The pinion gear 291 is arranged for rotation about a shaft 293 which shaft is in turn supported by the plate 289 and the pinion gear is positioned so that the teeth thereof engage the teeth 287 of the rod 231.

As previously noted, and as seen in FIG. 1, the support cone bearing seat 125 is in direct contact with, and is vertically supported by, the support cone bearing 129. Further, the bearing 129 is coupled, with respect to vertical movement, to the mantle 191, through the clutch housing 131 and the support cone 141. It will therefore be understood that the vertical location of the rod 281, which is arranged for linear vertical movement corresponds directly to the vertical position of the mantle 191. The vertical position of the rod 281 may therefore be used to indicate the crusher setting, that is, the size to which the cone crusher will reduce material provided thereto. For the purpose of providing a direct calibrated crusher setting reading the pinion gear 291 may be coupled in any conventional manner desired to any conventional reading apparatus. Thus, for example, the pinion gear 291 might be used to directly drive a needle type indicator which is calibrated relative to the diameter of the material processed by the crusher. Alternatively, the rotation of the pinion gear 291 might be used to drive an intermediate transducer of any suitable type which would, in turn, provide an indication of the size of the material discharged by the crusher.

At this time it is appropriate to note that for the rod 281 to provide correct crusher setting readings it is necessary that the rod 281 be maintained in an abutting relationship with the bearing seat 125. It will therefore be understood that it is necessary to provide a mechanism which will bias or urge the rod 281 upwardly so that it is maintained in direct contact with the undersurface of the bearing seat 125. In the embodiment illustrated the biasing mechanism includes a pair of sealing rings (acting as piston rings) indicated at 301 and 303, respectively. The lower sealing ring 301 is fixed to the shaft 81 in any conventional manner and the upper ring 303 is fixed to the rod 281 in any conventional manner. One or more ports 305 are formed in the wall of the rod 81 thereby permitting a portion of the lubricating oil flowing through the rod to pass into the (piston) chamber formed between the rings 301 and 303. The lubricating oil, which is always flowing into the lubrication path 83 (the rod 281) under pressure, thus provides an upward force which acts upon the ring 303 urging it upwardly, thereby urging the rod 281 upwardly and maintaining the uppermost end of the rod in abutting contact with the undersurface of the bearing seat 125. To accommodate the rings 301 and 303 and to provide space for the vertical movement of the ring 303, a stepped bore, indicated at 307, is provided in the shaft 81. The stepped bore, which has a diameter greater than the diameter of the remainder of the bore (the lubrication path 83) of the shaft 81, extends, it will be noted, only a distance sufficient to accommodate the excursions of the rod 281. Upward movement of the ring 303 within the stepped bore will, of course compress any ambient air trapped between the uppermost portion of the stepped bore and the ring 303. Inasmuch as such compression of ambient air would cause undesired resistance to the upward movement of the rod 281, a venting port, indicating at 309, is provided in the shaft 81. The port 309, which extends into the stepped bore 307, permits air which would otherwise be trapped to escape, thereby permitting the rod 281 to move upward more easily.

Of course, the rod 281 may be maintained in abutting relationship with the bearing seat 125 by other, equivalent arrangements, not shown. For example, the upper portion of the bore of the shaft 81 could be enlarged and the bottom of a spring could be fixedly positioned at the lower terminus of the enlarged bore. In this arrangement a collar could be fixedly connected to the rod 281 near the top portion thereof and the top of the spring could be fixedly connected to the underside of the collar, thereby compressing the spring between the lower terminus of the enlarged bore and the collar attached to the rod 281. The compression force of the spring thus would serve to urge the rod 281 upwardly. Clearly, selection of a spring having suitable parameters would be a simple matter of engineering design, it being understood that such parameters would, in part, be dependent upon the weight of the rod and the distance between the collar and the lower terminus of the enlarged bore. It is thus seen that an arrangement utilizing a spring to maintain the uppermost portion of the rod 281 in contact with the underside of the support cone bearing seat 125, which spring arrangement is a viable alternative for the piston arrangement illustrated, has been described.

Figure 6:
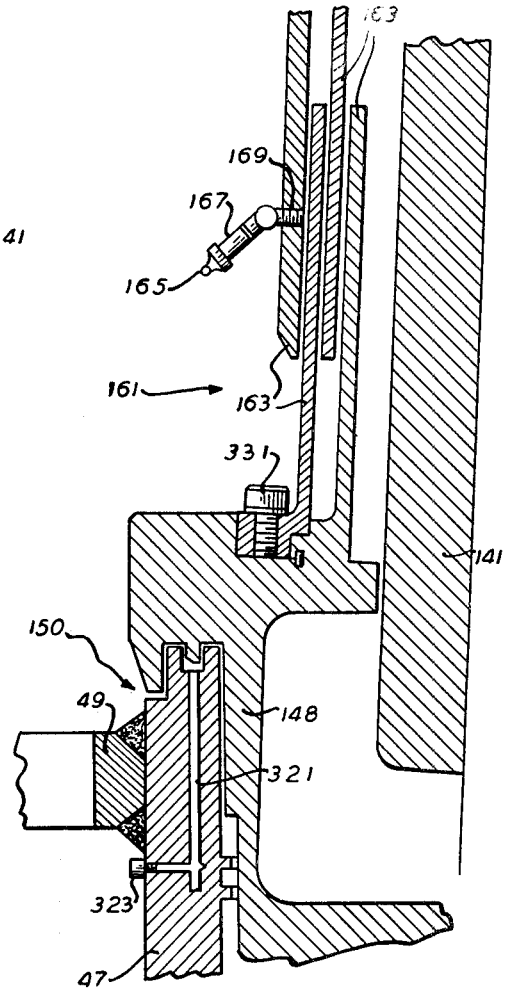
FIG. 6 is a detailed cross-sectional plan view of the sealing arrangement of the instant cone crusher.

Turning now to FIG. 6, the flywheel 148, the uppermost part of the tubular member 47, a labyrinth seal 150 and the telescoping labyrinth seal 161 are shown in greater detail. The flywheel 148, which may be made of steel, is bolted (as indicated at 152 in FIG. 1) to the lower portion of the eccentric sleeve 91 and rotates therewith. To prevent grit, for example, rock dust, from entering into the interior of the crusher through the space between the rotating flywheel 148 and the stationary member 47, the grease filled labyrinth seal, indicated at 150, is provided. A grease path 321, which is connected to a standard grease fitting 323, is formed within the member 47, thus providing a path through which grease may be injected into the voids of the seal. It is appropriate to note at this point, because it is most clearly shown in FIG. 6, that the lower sealing rings 163 are connected by, for example, screws such as the one indicated at 331, to the flywheel 148. In this manner the required support for the lower sealing rings 163 of the labyrinth seal 161 may be provided.

Turning now briefly to FIG. 7, the slotted annulus 45 is illustrated in detail. In particular, it will be noted that the tubular member 69, which forms the housing for the drive shaft 71, is welded to the walls of the slot, which slot is indicated at 341. In addition, FIG. 7 clearly illustrates the annular nature of, and the concentric relationship between, the shaft 81, the hub 41, the hub shoulder 43 and the annulus 45.

OPERATION OF THE CRUSHER

As previously indicated, the function of the crusher is to receive large pieces of hard material and to reduce the large pieces to a number of smaller pieces of relatively uniform size. In operation, chunks of a material such as rock are fed into the feed hopper 1. The pieces of rock drop into the crushing chamber, which is defined by the area bounded by the concave 17 and the mantle 191, where they are then crushed, or compressed, or fractured by striking one another, resulting in their breakage into smaller pieces. The size of the pieces passing through the crushing chamber and out of the crusher unit is determined by the space between the mantle 191 and the concave 17. This space or distance is in turn controlled, as previously indicated, by the piston 97. As is clear from FIG. 1, linearly upward movement of the piston 97 causes the mantle 191 to move upward, that is, closer to the concave 17, whereas lowering the piston 97 causes the mantle 191 to move downward, further from the stationary concave 17. To effect the vertical movement of the mantle 191, hydraulic fluid is pumped into, or withdrawn, through the tubing and coupling combination 99. After the mantle 191 has been positioned at the vertical level desired, the combination 99 is effectively removed from the system by, for example, closing a valve (not shown) and the vertical position of the mantle 191 is thus set. As is well known in the art, however, large pieces of material which are too hard to be crushed (reduced in size) by the action of the mantle and concave occasionally enter the unit. It is because of this fact that the accumulator 107 and the gas filled bag 111 are provided. In the event that a large piece of excessively hard material (frequently referred to in the art as "tramp metal") is provided to the crusher, the mantle 191 will obviously be forced downwardly. The downward movement of the mantle will, in turn, cause the piston 97 to move downwardly, thereby forcing some of the hydraulic fluid in the piston chamber 95 and/or the tubing 101 into the accumulator 107. (it having been noted above that the combination 99 has been effectively removed from the system). Because hydraulic fluid is not compressible, while gas is, the increased pressure on the gas in the bag 111, caused by the increased quantity of hydraulic fluid in the accumulator 107, will cause the compression of both the gas bag 111 and the gas therein. After the mantle 191 has been forced downward by the tramp metal a distance sufficient to permit the tramp metal to pass between the mantle 191 and the concave 17 (and the metal is passed by the crusher), the compressed gas in the gas bag 111 expands, forcing hydraulic fluid back into the chamber 95 and thereby raising the pistion 97 to the level at which it was prior to the entry of the tramp metal into the crushing chamber.

As just noted, the size of the material passed by the cone crusher is dependent upon the spacing between the mantle 191 and the concave 17. Clearly, it is desirable to be able to determine, prior to the operation of the crusher, the size of the pieces which the crusher will provide. Although the structure of the crusher setting indicator has already been discussed in detail with regard to FIG. 5, it is believed appropriate at this time to briefly explain the procedure involved in calibrating, or "zeroing", the crusher setting indicator. As is well known in the art, it is relatively easy to determine the vertical position or height to which the piston 97 has raised the support cone bearing seat 125. The mantle 191 undergoes continuous wear, however, and thus merely knowing the height to which the seat 125 has been raised is insufficient to permit an operator to accurately determine the distance between the mantle 191 and the concave 17. Utilization of the instant crusher setting indicator, however, permits the operator to raise the piston 97 to its maximum height which is, of course, the height at which the mantle 191 contacts the concave 17. Under such conditions it is a simple matter for the operator to "zero" a gauge or other indicator controlled by the pinion gear 291 so as to indicate "zero", that is, the absence of space between the concave and mantle. The operator may then lower the piston 97 and the indicator controlled by the pinion gear will accurately reflect the true vertical distance between the concave and mantle. In this manner the described crusher setting indicator compensates for mantle and concave wear and accurately reflects the true spacing therebetween.

As previously noted, the size of the material provided by the crusher is determined by the distance between the mantle 191 and the concave 17. The reducing action of the crusher is, however, as is well known in the art, provided by the gyration of the mantle relative to the concave, the gyration of the mantle having the effect of constanty increasing and decreasing the space between the mantle and the concave. The desired gyratory motion of the mantle is here provided for by the rotation of the drive shaft 71 which causes the eccentric sleeve 91 to rotate about the stationary shaft 81. Because the sleeve 91 has an eccentric configuration, as illustrated and as is conventionally known in the art, the support cone 141 and the mantle 191 firmly affixed to the cone 41 will gyrate.

Figure 2:
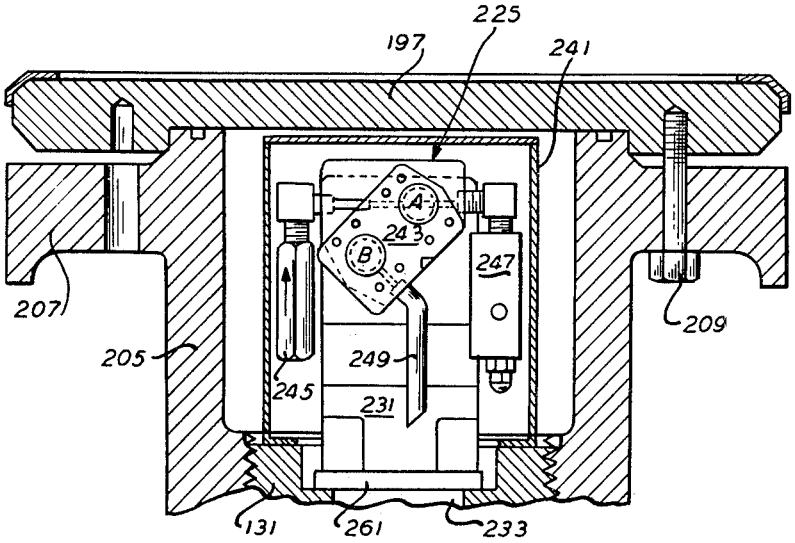
FIG. 2 is a detailed cross-sectional plan view of the anti-spin mechanism of the instant invention.
Figure 2A:
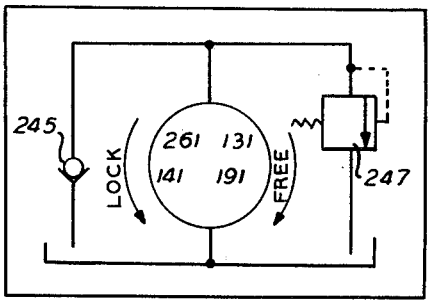
FIG. 2A is a schematic representation of the anti-spin mechanism shown in FIG. 1.

At this point it is appropriate to discuss the operation of the anti-spin mechanism 225 and it is noted that the structure and operation of the mechanism is most clearly shown in FIGS. 2 and 2A. As previously indicated, the mantle 191 gyrates due to the rotation of the eccentric 91. It is well known in the art, however, that the mantle 191 also rotates as the eccentric 91 rotates notwithstanding the fact that the bearing surface between the support cone 141 and the eccentric 91 is well lubricated (as will be more fully described below) in an attempt to reduce friction and wear. In particular, it is well known that when the crusher is operating in a "no-load" condition, that is, the eccentric 91 is driven and no material is being fed to the crusher unit, the mantle 191 tends to rotate in the same direction as the eccentric 91. It is further known in the art that when the crusher is in the process of crushing material, that is, when it is under load, the mantle 191 tends to rotate in a direction opposite to that in which it rotates when it is not under load. The design of the internal mechanism of the crusher unit is, as is conventional in the art, such that mantle rotation in the "load" direction is permissable while rotation in the no-load direction is to be avoided because such rotation can cause extensive wear to the mantle and concave. To prevent mantle rotation in the no-load direction the anti-spin mechanism 225 is utilized. In particular, the anti-spin mechanism is arranged so that the mantle 191 may rotate in the load direction but will be prevented (within limits which are more fully discussed below) from rotating in the no-land direction.

Referring now to FIGS. 2 and 2A, it will be understood that when the crusher is under load the motor 231 is caused to rotate in the "load" direction by the rotation of the clutch housing 131 which is fixedly connected to the support cone 141. The rotation of the motor 231 in the load direction causes the lubricating fluid within the reservoir 241 to be drawn upwardly through the check valve 245 and the fluid is returned to the reservoir through the manifold 243 and the tubing 249. However, when the the motor 231 is caused to rotate in the no-load direction the lubricating fluid is drawn into the manifold 243 through the tubing 249. The fluid cannot, however, be returned to the reservoir chamber through the check valve 245 because it is a unidirectional valve. Furthermore the fluid cannot be returned to the reservoir chamber through the ball-type relief valve 247 because the valve 247 is biased closed by the action of a conventional spring loaded mechanism, not shown. In this manner the motor 231 is prevented from rotating in the no-load direction and the mantle 191 is therefore also barred from rotating in the no-load direction. In the event, however, that the mantle 191 is urged to rotate in the no-load direction with sufficient force (urging the motor housing 231 to rotate in such direction as well) then, rather than risk the possible breakage of components of the crusher, the motor 231 is permitted to rotate in the no-load direction, thereby permitting the mantle 191 to also rotate in the otherwise undesired direction. To accomplish this end the spring maintaining the relief valve 247 in a closed condition is so selected as to permit the lubricating fluid to open the valve 247 when the fluid pressure applied to the spring is sufficient to overcome the counter-acting spring force, thereby permitting the fluid to return to the reservoir and the motor and mantle to rotate. It will further be understood that the just described anti-spin mechanism is self-resetting. Thus when the mantle 191 has been forced to rotate in the no-load direction (the relief valve 247 has opened) and the force applied to the mantle 191 is subsequently reduced to a level below that necessary to overcome the countervailing spring force of the valve, the spring will again close the valve, once again preventing the rotation of the mantle 191 in the no-load direction.

Turning now briefly to a discussion of the lubricating system of the crusher, it is first noted that many portions of the system have already been discussed. Thus, for example the lubricating paths 83 and 127, the fact that the lubricating fluid fills the chamber within the clutch housing 131 and within the reservoir 241, and the fact that the same lubricating fluid may be utilized to urge the crusher setting indicator rod 281 upward, have already been discussed. Nevertheless, it is believed appropriate at this point to briefly note the major features of the system. Initialy, it is appropriate to indicate that the lubricating fluid is not merely injected into the crusher system where it remains inactive but, rather, that the overall lubrication system, some portions of which are not illustrated, is a constantly circulating system. As a starting point, it may be noted that lubricating fluid flows into the lubrication paths 33 via the fitting 283. The lubricating fluid also passes through the ports 85 and thus between the eccentric 91 and the shaft 81. In addition, the lubricating fluid fills the chamber bounded by the lower portion of seat 125, the upper portion of the shaft 81 and the radially inner portion of the eccentric 91. The lubricating fluid is further conducted along the path indicated at 127 and coats the bearing surface between the support cone bearing 129 and the support cone bearing seat 125. Clearly, therefore, the fluid also fills the chamber radially outward of the bearing 129 and the seat 125. In addition, the lubricating fluid fills the chamber within the clutch housing 131 and, as noted above, it fills the anti-spin mechanism reservoir 241. Additionally, the lubricating fluid flows into the chamber bounded by the radially outward portion of the hub 41, the lower portion of the bevel gear drive assembly 73 and the upper portion of the shaft housing member 69. The lubricating fluid is conducted from the last described chamber through a drain coupling 365 (most clearly seen in FIG. 3) by a pump (not shown) and through a filtration system (not shown) from which it may be returned to the crusher via the fitting 283. It is thus seen that the lubrication system of the instant crusher insures a constantly circulating supply of clean lubricating fluid.

It will be understood that the foregoing description of the preferred embodiment of the present invention is for purposes of illustration only and that the various structural and operational features as herein disclosed are susceptible to a number of modifications and changes none of which entail any departure from the spirit and scope of the present invention as defined in the hereto appended claims.

Having thus described the invention, what is claimed and desired to be protected by Letters Patent is:

1. An anti-spin mechanism for a cone crusher, said cone crusher including a gyratory mantle which is urged to rotate in a first direction when said crusher is under load and in a second direction, opposite to said first direction, when said crusher is not under load, comprising:

a reservoir containing a fluid;

a fluid pump positioned within said reservoir and coupled to said mantle, said pump adapted to urge said fluid in a first flow direction when said mantle rotates in said first direction and to urge said fluid in a second flow direction, opposite to said first flow direction, when said mantle rotates in said second direction, the force with which said pump urges said fluid to flow being directly related to the force with which said mantle is urged to rotate;

a first valve positioned in said reservoir and coupled to said fluid pump, said first valve arranged to provide a fluid flow path, thereby permitting said mantle to rotate, only when said pump urges said fluid to flow in said first flow direction; and a second valve positioned in said reservoir and coupled to said fluid pump, said second valve arranged to provide a fluid flow, thereby permitting said mantle to rotate in said second direction, only when said pump urges said fluid to flow in said second direction with a force exceeding a predetermined magnitude.

2. An anti-spin mechanism according to claim 1 further comprising a manifold positioned in said reservoir and fluidly coupling said pump to said first and second valves.

3. An anti-spin mechanism according to claim 1 wherein said pump comprises:

a motor;

a motor housing connected to said motor; and a motor shaft coupled to said motor for rotation relative thereto, said motor housing being coupled to said mantle for rotation in response to the rotation of said mantle, said motor shaft being stationary.

4. An anti-spin mechanism according to claim 1 wherein said second valve is a ball valve.

5. An anti-spin mechanism according to claim 1 wherein said second valve includes means biasing said valve closed with a force having a predetermined magnitude.

6. An anti-spin mechanism according to claim 1 wherein said biasing means is a spring.

* * * * *